US008839889B2

(12) United States Patent
DiGiovanni et al.

(10) Patent No.: US 8,839,889 B2
(45) Date of Patent: Sep. 23, 2014

(54) POLYCRYSTALLINE DIAMOND COMPACTS, CUTTING ELEMENTS AND EARTH-BORING TOOLS INCLUDING SUCH COMPACTS, AND METHODS OF FORMING SUCH COMPACTS AND EARTH-BORING TOOLS

(75) Inventors: Anthony A. DiGiovanni, Houston, TX (US); Iain P. Goudemond, Gauteng (ZA)

(73) Assignees: Baker Hughes Incorporated, Houston, TX (US); Element Six Ltd, County Clare (IE)

( * ) Notice: Subject to any disclaimer, the term of this patent is extended or adjusted under 35 U.S.C. 154(b) by 556 days.

(21) Appl. No.: 13/094,075

(22) Filed: Apr. 26, 2011

(65) Prior Publication Data

US 2011/0266059 A1 Nov. 3, 2011

Related U.S. Application Data

(60) Provisional application No. 61/328,766, filed on Apr. 28, 2010.

(51) Int. Cl.
*E21B 10/46* (2006.01)
*E21B 10/567* (2006.01)
*B24D 99/00* (2010.01)

(52) U.S. Cl.
CPC ..... *B24D 99/005* (2013.01); *E21B 10/567* (2013.01)
USPC ..... 175/434; 175/433

(58) Field of Classification Search
USPC ..... 175/434, 433
See application file for complete search history.

(56) References Cited

U.S. PATENT DOCUMENTS

| | | | | |
|---|---|---|---|---|
| 3,745,623 | A | 7/1973 | Wentorf, Jr. et al. | |
| 4,224,380 | A | 9/1980 | Bovenkerk et al. | |
| 5,127,923 | A | 7/1992 | Bunting et al. | |
| 5,954,147 | A | 9/1999 | Overstreet et al. | |
| 7,866,418 | B2 * | 1/2011 | Bertagnolli et al. | 175/420.2 |
| 7,942,219 | B2 * | 5/2011 | Keshavan et al. | 175/434 |
| 8,071,173 | B1 * | 12/2011 | Sani | 427/337 |
| 8,202,335 | B2 * | 6/2012 | Cooley et al. | 51/307 |
| 8,365,844 | B2 * | 2/2013 | Voronin et al. | 175/374 |
| 8,365,846 | B2 * | 2/2013 | Dourfaye et al. | 175/433 |

(Continued)

OTHER PUBLICATIONS

International Search Report for International Application No. PCT/US2011/033883 mailed Oct. 25, 2011, 4 pages.

(Continued)

*Primary Examiner* — Jennifer H Gay
(74) *Attorney, Agent, or Firm* — TraskBritt, P.C.

(57) ABSTRACT

Methods of forming a polycrystalline diamond compact for use in an earth-boring tool include forming a body of polycrystalline diamond material including a first material disposed in interstitial spaces between inter-bonded diamond crystals in the body, removing the first material from interstitial spaces in a portion of the body, selecting a second material promoting a higher rate of degradation of the polycrystalline diamond compact than the first material under similar elevated temperature conditions and providing the second material in interstitial spaces in the portion of the body. Methods of drilling include engaging at least one cutter with a formation and wearing a second region of polycrystalline diamond material comprising a second material faster than the first region of polycrystalline diamond material comprising a first material. Polycrystalline diamond compacts and earth-boring tools including such compacts are also disclosed.

14 Claims, 6 Drawing Sheets

(56) References Cited

U.S. PATENT DOCUMENTS

| | | | | |
|---|---|---|---|---|
| 8,499,861 | B2 * | 8/2013 | Keshavan et al. | 175/434 |
| 2006/0201712 | A1 | 9/2006 | Zhang et al. | |
| 2007/0039762 | A1 | 2/2007 | Achilles | |
| 2008/0185189 | A1 | 8/2008 | Griffo et al. | |
| 2008/0223623 | A1 | 9/2008 | Keshavan et al. | |
| 2008/0230280 | A1 | 9/2008 | Keshavan et al. | |
| 2009/0090563 | A1 | 4/2009 | Voronin et al. | |
| 2009/0173015 | A1 | 7/2009 | Keshavan et al. | |
| 2009/0313908 | A1 | 12/2009 | Zhang et al. | |
| 2010/0084197 | A1 | 4/2010 | Voronin et al. | |
| 2010/0095602 | A1 | 4/2010 | Belnap et al. | |
| 2010/0243335 | A1 * | 9/2010 | Dourfaye et al. | 175/433 |
| 2010/0243336 | A1 * | 9/2010 | Dourfaye et al. | 175/434 |
| 2010/0294571 | A1 * | 11/2010 | Belnap et al. | 175/434 |
| 2011/0023375 | A1 | 2/2011 | Sani et al. | |
| 2011/0030283 | A1 | 2/2011 | Cariveau et al. | |
| 2011/0036643 | A1 | 2/2011 | Belnap et al. | |
| 2011/0083908 | A1 | 4/2011 | Shen et al. | |
| 2011/0083909 | A1 | 4/2011 | Shen et al. | |
| 2011/0271603 | A1 | 11/2011 | Voronin et al. | |
| 2012/0111642 | A1 * | 5/2012 | Digiovanni | 175/428 |
| 2012/0241224 | A1 * | 9/2012 | Qian et al. | 175/428 |

OTHER PUBLICATIONS

International Written Opinion for International Application No. PCT/US2011/033883 mailed Oct. 25, 2011, 4 pages.

International Preliminary Report on Patentability for International Application No. PCT/2011/033883 dated Oct. 30, 2012, 5 pages.

* cited by examiner

POLYCRYSTALLINE DIAMOND COMPACTS, CUTTING ELEMENTS AND EARTH-BORING TOOLS INCLUDING SUCH COMPACTS, AND METHODS OF FORMING SUCH COMPACTS AND EARTH-BORING TOOLS

CROSS-REFERENCE TO RELATED APPLICATION

This application claims the benefit of U.S. Provisional Patent Application Ser. No. 61/328,766, filed Apr. 28, 2010 and entitled "Polycrystalline Diamond Compacts, Cutting Elements and Earth-Boring Tools Including Such Compacts, and Methods of Forming Such Compacts," the disclosure of which is incorporated herein by reference in its entirety.

TECHNICAL FIELD

Embodiments of the present disclosure relate generally to polycrystalline diamond compacts, to cutting elements and earth-boring tools employing such compacts, and to methods of forming such compacts, cutting elements, and earth-boring tools.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, which are cutting elements that include cutting faces of a polycrystalline diamond material. Such polycrystalline diamond cutting elements are formed by sintering and bonding together relatively small diamond grains or crystals with diamond-to-diamond bonds under conditions of high temperature and high pressure in the presence of a catalyst (such as, for example, Group VIIIA metals including by way of example cobalt, iron, nickel, or alloys and mixtures thereof) to form a layer or "table" of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be swept into the diamond crystals during sintering and serve as the catalyst material for forming the diamond table from the diamond crystals. In other methods, powdered catalyst material may be mixed with the diamond crystals prior to sintering the crystals together in an HTHP process.

Upon formation of a diamond table using an HTHP process, catalyst material may remain in interstitial spaces between the crystals of diamond in the resulting polycrystalline diamond table. The presence of the catalyst material in the diamond table may contribute to thermal damage in the diamond table when the cutting element is heated during use due to friction at the contact point between the cutting element and the formation. Accordingly, the polycrystalline diamond cutting element may be formed by leaching the catalyst material (e.g., cobalt) out from interstitial spaces between the diamond crystals in the diamond table using, for example, an acid or combination of acids, e.g., aqua regia. All of the catalyst material may be removed from the diamond table, or catalyst material may be removed from only a portion thereof, for example, from the cutting face, from the side of the diamond table, or both, to a desired depth.

PDC cutters are typically cylindrical in shape and have a cutting edge at the periphery of the cutting face for engaging a subterranean formation. Over time, the cutting edge becomes dull. As the cutting edge dulls, the surface area in which the cutting edge of the PDC cutter engages the formation increases due to the formation of a so-called wear flat or wear scar extending into the side wall of the diamond table. As the surface area of the diamond table engaging the formation increases, more friction-induced heat is generated between the formation and the diamond table in the area of the cutting edge. Additionally, as the cutting edge dulls, the downward force or weight on the bit (WOB) must be increased to maintain the same rate of penetration (ROP) as a sharp cutting edge. Consequently, the increase in friction-induced heat and downward force may cause chipping, spalling, cracking, or delamination of the PDC cutter due to a mismatch in coefficient of thermal expansion between the diamond crystals and the catalyst material. In addition, at temperature of about 750° C. and above, presence of the catalyst material may cause so-called back-graphitization of the diamond crystals into elemental carbon.

Accordingly, there remains a need in the art for cutting elements that include a polycrystalline diamond table that increase the durability as well as the cutting efficiency of the cutter.

BRIEF SUMMARY

Embodiments of the present disclosure relate to methods of forming polycrystalline diamond compact (PDC) elements, such as cutting elements suitable for use in subterranean drilling, exhibiting enhanced cutting ability and thermal stability, and the resulting PDC elements formed thereby.

In some embodiments, the present disclosure includes methods of forming PDC cutting elements for earth-boring tools. A diamond table is formed that comprises a polycrystalline diamond material and a first material disposed in interstitial spaces between inter-bonded diamond crystals of the polycrystalline diamond material. The first material is at least substantially removed from the interstitial spaces in a portion of the polycrystalline diamond material, and a second material is then provided in the interstitial spaces between the inter-bonded diamond crystals in the portion of the polycrystalline diamond material in a peripheral portion of the diamond table. The second material is selected to promote a higher rate of degradation of the diamond crystals under elevated temperature conditions than a rate of degradation of the diamond material having the first material at least substantially removed from the interstitial spaces under substantially equivalent elevated temperature conditions. Removing the first material from the interstitial spaces in a portion of the polycrystalline diamond material may include at least substantially removing the first material from the interstitial spaces in an annular region of the diamond table substantially circumscribing an outer side peripheral surface of the diamond table.

In some embodiments, the present disclosure includes methods of forming PDC cutting elements for earth-boring tools. A diamond table is formed that comprises a polycrystalline diamond material and a first material disposed in interstitial spaces between inter-bonded diamond crystals of the polycrystalline diamond material. The first material is at least substantially removed from the interstitial spaces in a portion of the polycrystalline diamond material, and a second material is then introduced into the interstitial spaces between the inter-bonded diamond crystals. The second material may be selected to promote a higher rate of degradation of the polycrystalline diamond material responsive to exposure to an elevated temperature than a rate of degradation of the first material under a substantially equivalent elevated temperature.

In additional embodiments, the present disclosure includes methods of drilling. At least one cutting element is engaged with a formation, the at least one cutting element including a diamond table having a first region of polycrystalline diamond material comprising a first material in interstitial spaces between inter-bonded diamond crystals in the first region of polycrystalline diamond material and a second region of polycrystalline diamond material comprising a second material in interstitial spaces between diamond crystals in the second region of polycrystalline diamond material. The second material inducing a higher rate of degradation of the polycrystalline diamond material than the first material under approximately equal elevated temperatures. The second region of polycrystalline diamond material wears faster than the first region of polycrystalline diamond material as friction from engagement of the at least one cutter increases the temperature of the first region and the second region.

Further embodiments include PDC cutting elements for use in earth-boring tools. The cutting elements include a first region of polycrystalline diamond material comprising a first material in interstitial spaces between inter-bonded diamond crystals in the first region of polycrystalline diamond material, and a second region of polycrystalline diamond material comprising a second material in interstitial spaces between diamond crystals in the second region of polycrystalline diamond material. The second material may be selected to induce a higher rate of degradation of the polycrystalline diamond material than the first material under approximately the same elevated temperature.

In yet additional embodiments, the present disclosure includes earth-boring tools having a body and at least one PDC cutting element attached to the body. The at least one PDC cutting element comprises a diamond table on a surface of a substrate. The diamond table includes a first region of polycrystalline diamond material disposed adjacent a surface of the substrate, the first region comprising a first material in interstitial spaces between inter-bonded diamond crystals in the first region of polycrystalline diamond material, and a second region of polycrystalline diamond material located in a recess in a side of the first region of polycrystalline diamond material, the second region comprising a second material in interstitial spaces between inter-bonded diamond crystals in the second region of polycrystalline diamond material. The second material promoting a higher rate of degradation of the polycrystalline diamond material than the first material under substantially equivalent elevated temperatures.

Other features and advantages of the present disclosure will become apparent to those of ordinary skill in the art through consideration of the ensuing description, the accompanying drawings, and the appended claims.

BRIEF DESCRIPTION OF THE SEVERAL VIEWS OF THE DRAWINGS

While the specification concludes with claims particularly pointing out and distinctly claiming that which is regarded as the present invention, the advantages of this disclosure may be more readily ascertained from the description of embodiments of the disclosure when read in conjunction with the accompanying drawings, in which:

DETAILED DESCRIPTION

Some of the illustrations presented herein are not meant to be actual views of any particular material or device, but are merely idealized representations, which are employed to describe the present disclosure. Additionally, elements common between figures may retain the same numerical designation.

Embodiments of the present disclosure include methods for fabricating cutting elements that include a multi-portion diamond table comprising polycrystalline diamond material. In some embodiments, the methods employ the use of a catalyst material to form a portion of the diamond table.

As used herein, the term "drill bit" means and includes any type of bit or tool used for drilling during the formation or enlargement of a wellbore in a subterranean formation and includes, for example, rotary drill bits, percussion bits, core bits, eccentric bits, bicenter bits, reamers, mills, drag bits, roller cone bits, hybrid bits and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material.

As used herein, the term "inter-granular bond" means and includes any direct atomic bond (e.g., covalent, metallic, etc.) between atoms in adjacent grains of material.

As used herein, the term "catalyst material" refers to any material that is capable of substantially catalyzing the formation of inter-granular bonds between grains of hard material during an HTHP but at least contributes to the degradation of the inter-granular bonds and granular material under elevated temperatures, pressures, and other conditions that may be encountered in a drilling operation for forming a wellbore in a subterranean formation. For example, catalyst materials for diamond include cobalt, iron, nickel, other elements from Group VIIIA of the Periodic Table of the Elements, and alloys thereof.

Figure 1:
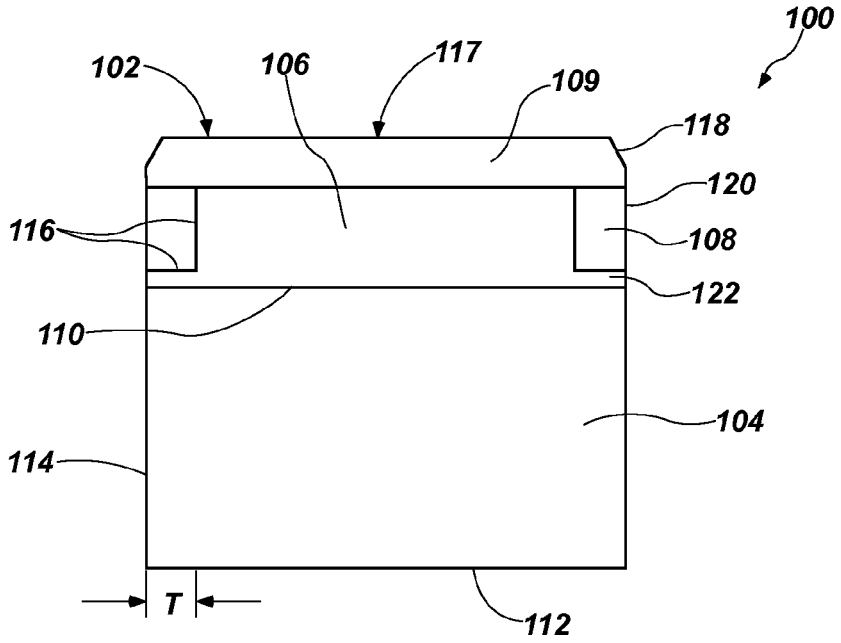
FIG. 1 illustrates an enlarged cross-sectional view of one embodiment of a cutting element having a multi-portion diamond table of the present disclosure.

FIG. 1 is a simplified enlarged cross-sectional view of an embodiment of a polycrystalline diamond compact (PDC) cutting element 100 of the present disclosure. The PDC cutting element 100 includes a multi-portion diamond table 102 that is provided on (e.g., formed on or attached to) a supporting substrate 104. In additional embodiments, the multi-portion diamond table 102 of the present disclosure may be formed without a supporting substrate 104, and/or may be employed without a supporting substrate 104. The multi-portion diamond table 102 may be formed on the supporting substrate 104, or the multi-portion diamond table 102 and the supporting substrate 104 may be separately formed and subsequently attached together. The multi-portion diamond table 102 includes a cutting face 117 opposite the supporting substrate 104. The multi-portion diamond table 102 may also, optionally, have a chamfered edge 118 at a periphery of the cutting face 117. The chamfered edge 118 of the PDC cutting element 100 shown in FIG. 1 has a single chamfer surface, although the chamfered edge 118 also may have additional chamfer surfaces, and such chamfer surfaces may be oriented at chamfer angles that differ from the chamfer angle of the chamfer edge 118, as known in the art. Further, in lieu of a chamfered edge 118, the edge may be rounded or comprise a combination of one or more chamfer and one or more arcuate surfaces.

The supporting substrate 104 may have a generally cylindrical shape as shown in FIG. 1. The supporting substrate 104 may have a first end surface 110, a second end surface 112, and a generally cylindrical lateral side surface 114 extending between the first end surface 110 and the second end surface 112.

Although the first end surface 110 shown in FIG. 1 is at least substantially planar, it is well known in the art to employ non-planar interface geometries between substrates and diamond tables formed thereon, and additional embodiments of the present disclosure may employ such non-planar interface geometries at the interface between the supporting substrate 104 and the multi-portion diamond table 102. Additionally, although cutting element substrates commonly have a cylindrical shape, like the supporting substrate substrate 104, other shapes of cutting element substrates are also known in the art, and embodiments of the present disclosure include cutting elements having shapes other than a generally cylindrical shape.

The supporting substrate 104 may be formed from a material that is relatively hard and resistant to wear. For example, the supporting substrate 104 may be formed from and include a ceramic-metal composite material (which are often referred to as "cermet" materials). The supporting substrate 104 may include a cemented carbide material, such as a cemented tungsten carbide material, in which tungsten carbide particles are cemented together in a metallic binder material. The metallic binder material may include, for example, a catalyst material such as cobalt, nickel, iron, or alloys and mixtures thereof.

With continued reference to FIG. 1, the multi-portion diamond table 102 may be disposed on or over the first end surface 110 of the supporting substrate 104. The multi-portion diamond table 102 may comprise a first portion 106, a second portion 108, and a third portion 109 as discussed in further detail below. The multi-portion diamond table 102 is primarily comprised of polycrystalline diamond material. In other words, diamond material may comprise at least about seventy percent (70%) by volume of the multi-portion diamond table 102. In additional embodiments, diamond material may comprise at least about eighty percent (80%) by volume of the multi-portion diamond table 102, and in yet further embodiments, diamond material may comprise at least about ninety percent (90%) by volume of the multi-portion diamond table 102. The polycrystalline diamond material include grains or crystals of diamond that are bonded together to form the diamond table. Interstitial regions or spaces between the diamond grains may be filled with additional materials or they may be at least substantially free of additional materials, as discussed below. Although the embodiments described herein comprise a multi-portion diamond table 102, in other embodiments, a different hard polycrystalline material may be used to form a polycrystalline compact, such as polycrystalline cubic boron nitride.

In one embodiment, the multi-portion diamond table 102 includes at least the first portion 106, the second portion 108, and the third portion 109. As shown in FIG. 1, the second portion 108 of the multi-portion diamond table 102 comprises an annular region extending around a periphery of the multi-portion diamond table 102. While the second portion 108 of the multi-portion diamond table 102 is illustrated as having at least substantially planar, mutually perpendicular sidewalls 116, it is understood that the second portion 108 may have other shapes. For example, a cross section of the second portion 108 may have an arcuate, a triangular, or a trapezoidal shape.

The second portion 108 may extend along a sidewall 120 of the multi-portion diamond table 102 from the supporting substrate 104 to the chamfered edge 118. The second portion 108 is separated from the cutting face 117 so that the third portion 109 includes the entire cutting face 117. In some embodiments, a segment 122 of the first portion 106 may be located between the second portion 108 and the supporting substrate 104. Having a segment 122 of the first portion 106 located between the second portion 108 and the supporting substrate 104 may help maintain the bond security of the multi-portion table 102 to the supporting substrate 104 during use of the cutting element 100. The second portion 108 may have a thickness T extending inward of sidewall 120 of about 50 microns to about 400 microns.

The third portion 109 may be located between the second portion 108 and the cutting face 117 of the diamond table 102. In some embodiments, the third portion 109 may also be located between the first portion 106 and the cutting face 117 of the diamond table 102. While the third portion 109 is illustrated in FIG. 1 as extending into the diamond table 102 from the cutting face 117 to about a depth of the second portion 108, in additional embodiments, the third portion 109 may extend farther downward from the cutting face 117 toward the supporting substrate 104.

Figure 2:
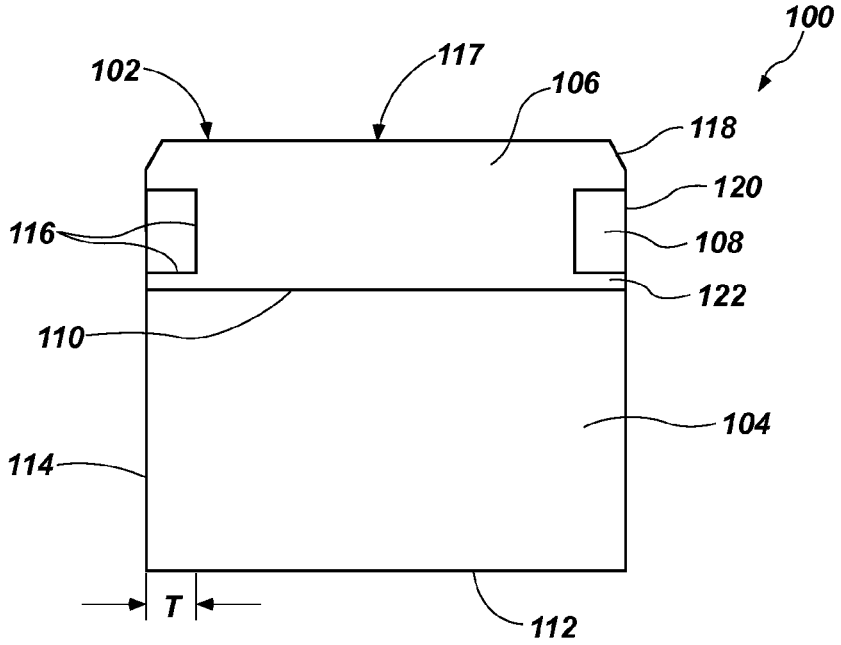
FIG. 2 illustrates an enlarged cross-sectional view of another embodiment of a cutting element having a multi-portion diamond table of the present disclosure.

In another embodiment, as shown in FIG. 2, the multi-portion diamond table 102 may include only the first portion 106 and the second portion 108. The second portion 108 may extend from the supporting substrate 104 to the cutting face 117.

Figure 3A:
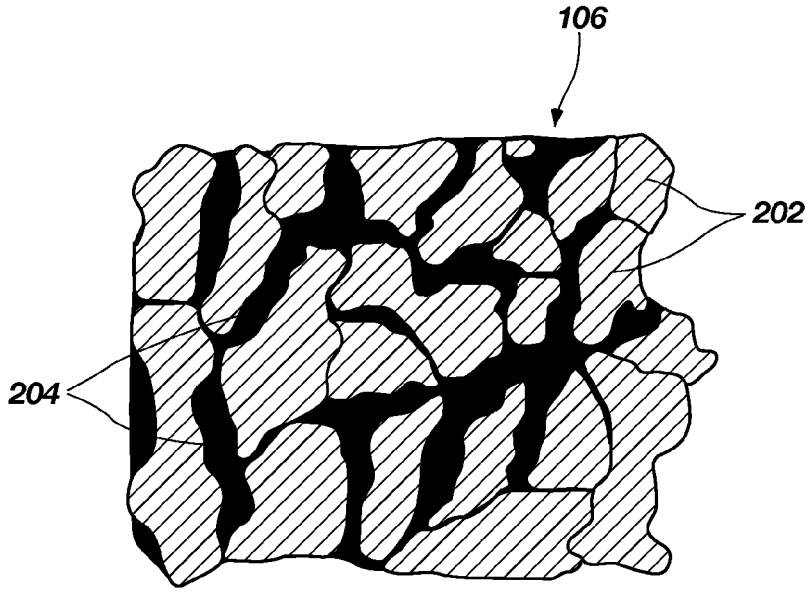
FIG. 3A is a simplified figure illustrating how a microstructure of the multi-portion diamond table of the cutting element shown in FIG. 1 and FIG. 2 may appear under magnification.
Figure 3B:
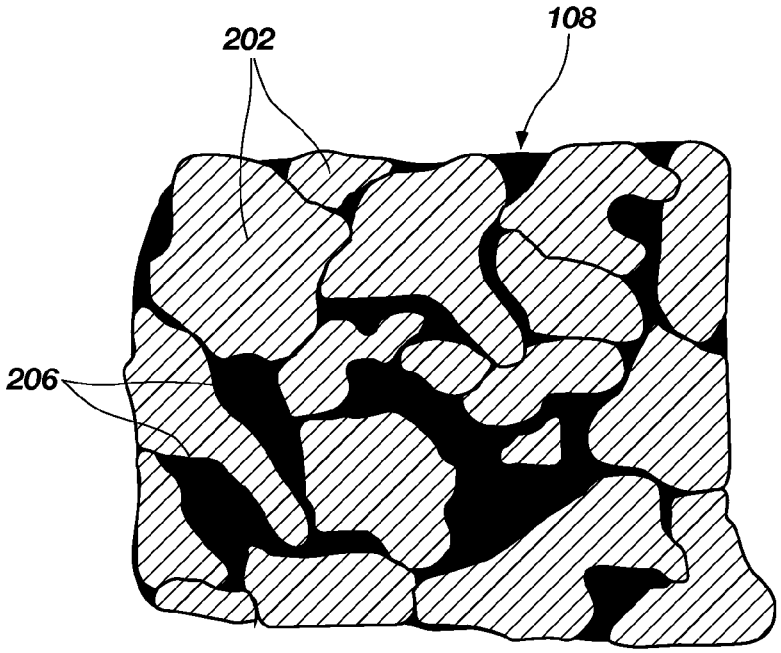
FIG. 3B is a simplified figure illustrating how a microstructure of another region of the multi-portion diamond table of the cutting element shown in FIG. 1 may appear under magnification.

FIG. 3A is an enlarged view illustrating how a microstructure of the first portion 106 of the multi-portion diamond table 102, shown in FIG. 1 and FIG. 2, may appear under magnification. FIG. 3B is an enlarged view illustrating how a microstructure of the second portion 108 of the multi-portion diamond table 102, shown in FIG. 1 and FIG. 2, may appear under magnification. Referring now to FIG. 3A, the first portion 106 includes diamond crystals 202 that are bonded together by inter-granular diamond-to-diamond bonds. The diamond crystals 202 may comprise natural diamond, synthetic diamond, or a mixture thereof, and may be formed using diamond grit of different crystal sizes (i.e., from multiple layers of diamond grit, each layer having a different average crystal size or by using a diamond grit having a multi-modal crystal size distribution).

A first material 204 may be disposed in interstitial regions or spaces between the diamond crystals 202 of first portion 106. In one embodiment, the first material 204 may comprise a catalyst material that catalyzes the formation of the inter-granular diamond-to-diamond bonds during formation of the multi-portion diamond table 102, and will promote degradation to the first portion 106 of multi-portion diamond table 102 when the PDC cutting element 100 is used for drilling. In additional embodiments, the first material 204 may have no effect on the diamond crystals 202 but rather, will be an at least substantially inert material.

In some embodiments, the first material 204 (FIG. 3A) may be removed from a portion of the diamond table 102 to a depth from the cutting face 117 toward supporting substrate 104, and inward of second portion 108 to form the third portion 109 (FIG. 1). The third portion 109 of the multi-portion diamond table 102 may be at least substantially free of the first material 204 and a second material 206.

Referring now to FIG. 3B, the second portion 108 includes a second material 206 disposed in interstitial regions or spaces between the diamond crystals 202. In some embodiments, the second material 206 is selected to cause a higher rate of degradation of the diamond crystals 202 than diamond crystals having the first material at least substantially removed from the interstitial regions between diamond crystals when the cutting element 101 is used for drilling. In additional embodiments, the second material 206 is selected to cause a higher rate of degradation of the diamond crystals 202 than the first material 204 when the cutting element 101 is used for drilling. As used herein, the phrase "rate of degradation" refers to a material that causes at least one of graphitization of the diamond crystals and weakening of the inter-granular diamond-to-diamond bonds at temperatures and pressures common in drilling. In other words, the second material 206 is selected to preferentially weaken the polycrystalline diamond structure of the second portion 108 relative to that of at least one of the third portion 109 or the first portion 106 during drilling as described in greater detail below.

The first material 204 and the second material 206 may each comprise a catalyst material known in the art for catalyzing the formation of inter-granular diamond-to-diamond bonds in the polycrystalline diamond materials. For example, the first material 204 and the second material 206 may each comprise a Group VIII element or an alloy thereof such as Co, Ni, Fe, Ni/Co, Co/Mn, Co/Ti, Co/Ni/V, Co/Ni, Fe/Co, Fe/Mn, Fe/Ni, Fe(Ni.Cr), Fe/$Si_2$, Ni/Mn, and Ni/Cr. The combination of the first material 204 and the second material 206 may be selected by one of ordinary skill in the art so long as the second material 206 promotes a higher rate of degradation of the diamond crystals 202 than the first material 204. For example, iron has a higher reactivity, and thus promotes a higher rate of degradation of diamond crystals 202 than cobalt under substantially equivalent elevated temperatures, as known in the art. Accordingly, in one embodiment, the first material 204 may comprise cobalt and the second material 206 may comprise iron. In another embodiment, the first material 204 may be at least substantially removed from the third portion 109 of the multi-portion diamond table 102 adjacent the cutting face 117 and the chamfer 118, and the second material 206 may comprise any of the aforementioned catalysts. For example, the second material 206 may comprise iron as iron has a higher reactivity, and thus promotes a higher rate of degradation of diamond crystals 202 than diamond crystals 202 having at least substantially void regions between the diamond crystals 202. In yet another embodiment, the first material 204 may be removed from a majority of the diamond table 102 to a substantial depth from the cutting face toward supporting substrate 104, and inward of second portion 108. The second material 206 may also comprise a combination of more than one material. For example, the second material 206 may be formed as a gradient of more than one material such that the rate of degradation of the second material 206 near the sidewall 120 of the multi-portion diamond table 102 is higher than the rate of degradation of the second material 206 near an interior of the multi-portion diamond table 102.

Figure 4A:
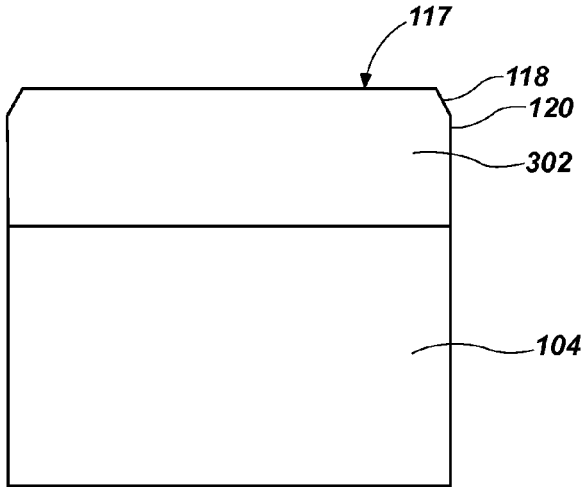
FIGS. 4A through 4C depict one embodiment of forming the cutting element having the multi-portion diamond table of the FIG. 1.
Figure 4B:
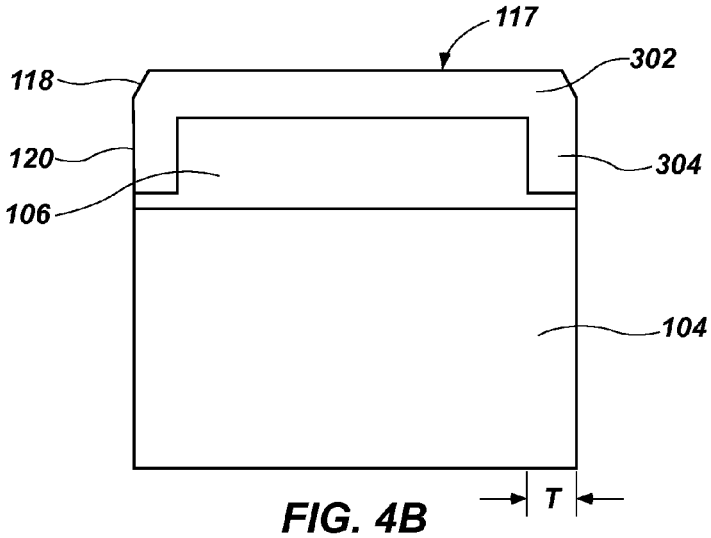
Figure 4C:
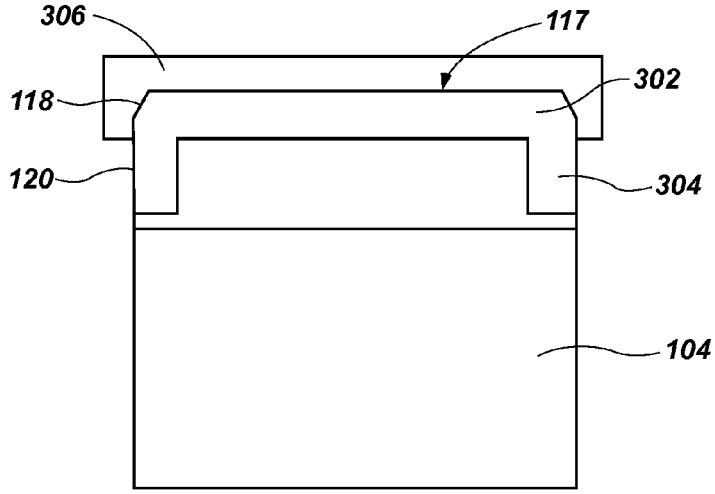

FIGS. 4A through 4C illustrate one embodiment of a method of forming the multi-portion diamond table 102 of FIG. 1. As shown in FIG. 4A, a diamond table 302 comprising the first material 204 (FIG. 3A) is formed on the supporting substrate 104. The diamond table 302 may be formed using a high temperature/high pressure (HTHP) process. Such processes, and systems for carrying out such processes, are generally known in the art and described by way of non-limiting example, in U.S. Pat. No. 3,745,623 to Wentorf et al. (issued Jul. 17, 1973), and U.S. Pat. No. 5,127,923 Bunting et al. (issued Jul. 7, 1992), the disclosure of each of which patents is incorporated herein in its entirety by this reference. In some embodiments, the first material 204 (FIG. 3A) may be supplied from the supporting substrate 104 during an HTHP process used to form the diamond table 302. For example, the supporting substrate 104 may comprise a cobalt-cemented tungsten carbide material. The cobalt of the cobalt-cemented tungsten carbide may serve as the first material 204 during the HTHP process.

To form the diamond table 302 in an HTHP process, a particulate mixture comprising diamond granules or particles may be subjected to elevated temperatures (e.g., temperatures greater than about one thousand degrees Celsius (1,000° C.)) and elevated pressures (e.g., pressures greater than about five gigapascals (5.0 GPa)) to form inter-granular bonds between the diamond granules or particles.

Once formed, the diamond table 302 (FIG. 4A) may be masked (not shown), as known in the art, so that the cutting face 117 and a portion of the sidewall 120 of the diamond table 203 are exposed. The unmasked portions of the diamond table 302 are then leached using a leaching agent to remove the first material 204 (FIG. 3A) forming a leached portion 304 of the diamond table 302 (FIG. 4B). The portion of the diamond table 302 that is not leached at least substantially corresponds to the first portion 106 (FIG. 1). The leached portion 304 at least substantially corresponds to the area of the second portion 108 and the third portion 109 (FIG. 1). Such leaching agents are known in the art and described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which is incorporated herein in its entirety by this reference. Specifically, aqua regia (a mixture of concentrated nitric acid ($HNO_3$) and concentrated hydrochloric acid (HCl)) may be used to at least substantially remove the first material 204 (FIG. 3A) from the interstitial voids between the diamond crystals 202 in the first portion 106 (FIG. 1). It is also known to use boiling hydrochloric acid (HCl) and boiling hydrofluoric acid (HF) as leaching agents. One particularly suitable leaching agent is hydrochloric acid (HCl) at a temperature of above 110° C., which may be provided in contact with unmasked portion of the diamond table 302 for a period of about 30 minutes to about 60 hours, depending upon the desired thickness T (FIG. 1) of the leached portion 304. The supporting substrate 104 and a portion of the diamond table 302 at least substantially corresponding to the area of the first portion 106 (FIG. 1) of the multi-portion diamond table 102 may be precluded from contact with the leaching agent by encasing the supporting substrate 104 and a portion of the diamond table 302 in a plastic resin or masking material (not shown). In another embodiment, only the supporting substrate 104 may be precluded from contact with the leaching agent, and a substantial depth of diamond table 302 may be leached downward from the cutting face 117 (FIG. 1) toward the supporting substrate 104, as known in the art. As known in the art, it is desirable that the first material 204 remain within the diamond table 302 to some thickness proximate the interface with supporting substrate 104 to maintain mechanical strength and impact resistance of diamond table 302.

As shown in FIG. 4C, a mask 306 may be formed over the cutting face 117 and a portion of the sidewalls 120 of the diamond table 302. The exposed portions of the leached portion 304 on the sidewalls 120 may then be filled with the second material 206 (FIG. 3B) to form the second portion 108 (FIG. 1). The diamond table 302 may then be subjected to a second HTHP process causing the second material 206 to infiltrate the leached portion 304 forming the second portion 108 of the multi-portion diamond table 102 (FIG. 1). In other embodiments, the second material 206 may be deposited into the leached portion 304 using a physical vapor deposition (PVD) process or chemical vapor deposition (CVD) process such as a plasma-enhanced chemical vapor deposition process (PECVD), as known in the art. PVD includes, but is not limited to, sputtering, evaporation, or ionized PVD. Such deposition techniques are known in the art and, therefore, are not described in detail herein. Where a major portion of the diamond table 302 has been leached downward from cutting face 117 toward supporting substrate 104 so that the portion of diamond table 302 interior of region 304 is substantially free of first material 204, the thickness T of the second portion 108 (FIG. 1) may be achieved by controlling the time of the deposition process, as known in the art. Once the second portions 108 are filled with the second material 206 (FIG. 3B), the mask 306 may be removed exposing the third portion 109 (FIG. 1).

Figure 5A:
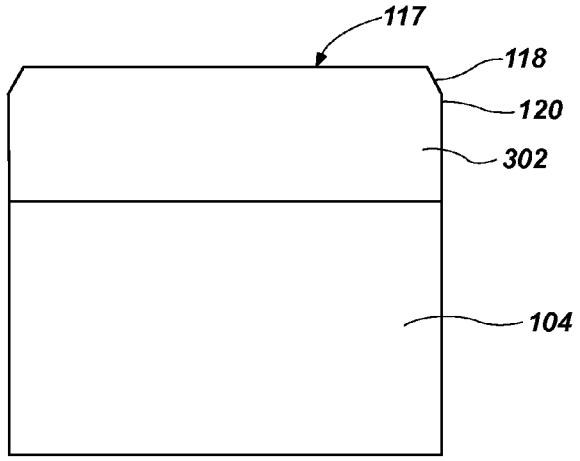
FIGS. 5A through 5C depict one embodiment of forming the cutting element having the multi-portion diamond table of FIG. 2.
Figure 5B:
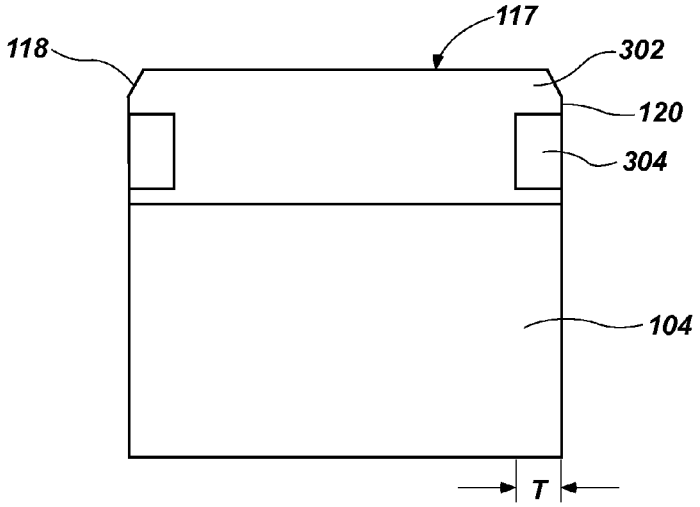
Figure 5C:
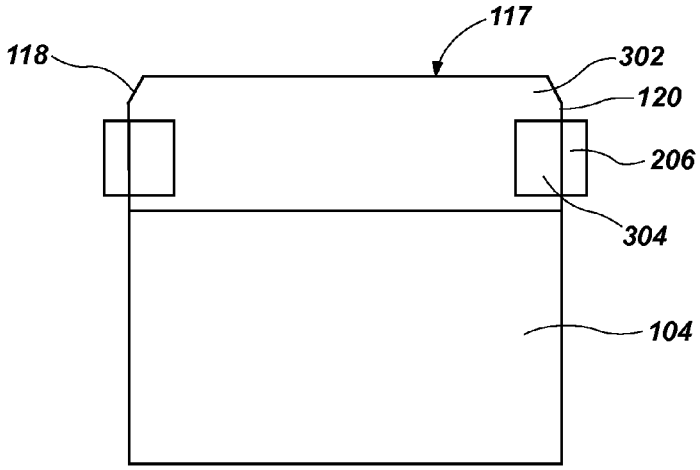

FIGS. 5A through 5C illustrate one embodiment of a method of forming the multi-portion diamond table 102 of FIG. 2. FIG. 5A illustrates a diamond table 302 comprising the first material 204 (FIG. 3A) formed on the supporting substrate 104, which is a substantial duplication of FIG. 4A and may be formed as described above regarding FIG. 4A.

Once formed, the diamond table 302 (FIG. 5A) may be masked (not shown), as known in the art, so that only portions of the diamond table 302 intended to become the second portion 108 (FIG. 2) are exposed. The unmasked portions of the diamond table 302 are then leached using a leaching agent to remove the first material 204 (FIG. 3A) forming a leached portion 304 of the diamond table 302 (FIG. 5B). The leached portion 304 at least substantially corresponds to the area of the second portion 108 (FIG. 2). The leached portion 304 may be formed using a leaching agent as previously discussed regarding FIG. 4B. The supporting substrate 104 and a portion of the diamond table 302 at least substantially corresponding to the area of the first portion 106 (FIG. 2) of the multi-portion diamond table 102 may be precluded from contact with the leaching agent by encasing the supporting substrate 104 and a portion of the diamond table 302 in a plastic resin or masking material (not shown). In another embodiment, only the supporting substrate 104 may be precluded from contact with the leaching agent, and a substantial depth of diamond table 302 may be leached downward from the cutting face 117 (FIG. 2) toward the supporting substrate 104, as known in the art. As known in the art, it is desirable that that the first material 204 remain within the diamond table 302 to some thickness proximate the interface with supporting substrate 104 to maintain mechanical strength and impact resistance of diamond table 302.

If only a portion of the diamond table 302 is leached, for example an annular portion adjacent the sidewall 120, the second material 206 (FIG. 3B) may then be deposited into the leached portion 304 to form the second portion 108 of the multi-portion diamond table 102 (FIG. 2). In one embodiment, as shown in FIG. 5C, a powder comprising the second material 206 may be placed on the leached portion 304. The supporting substrate 104 and the portion of the diamond table 302 at least substantially corresponding to the first portion 106 (FIG. 2) may remain masked so as not to contact the second material 206, or a new mask may be formed on the supporting substrate 104 and the portion of the diamond table 302 at least substantially corresponding to the first portion 106. Alternatively, if a major portion of the diamond table 302 is leached downward from the cutting face 117 toward supporting substrate 104, the portion of the diamond table 302 at least substantially corresponding to the first portion 106 (FIG. 2) is masked on the cutting face 117, the chamfer 118 and portions of the sidewall 120 above and below region 304 so as not to be contacted by the second material 206. The exposed portions of the leached portion 304 on the sidewalls 120 may be filled with the second material 206 (FIG. 3B) using a second HTHP process, a PVD process, or a CVD process as previously discussed regarding FIG. 4C.

Figure 6:
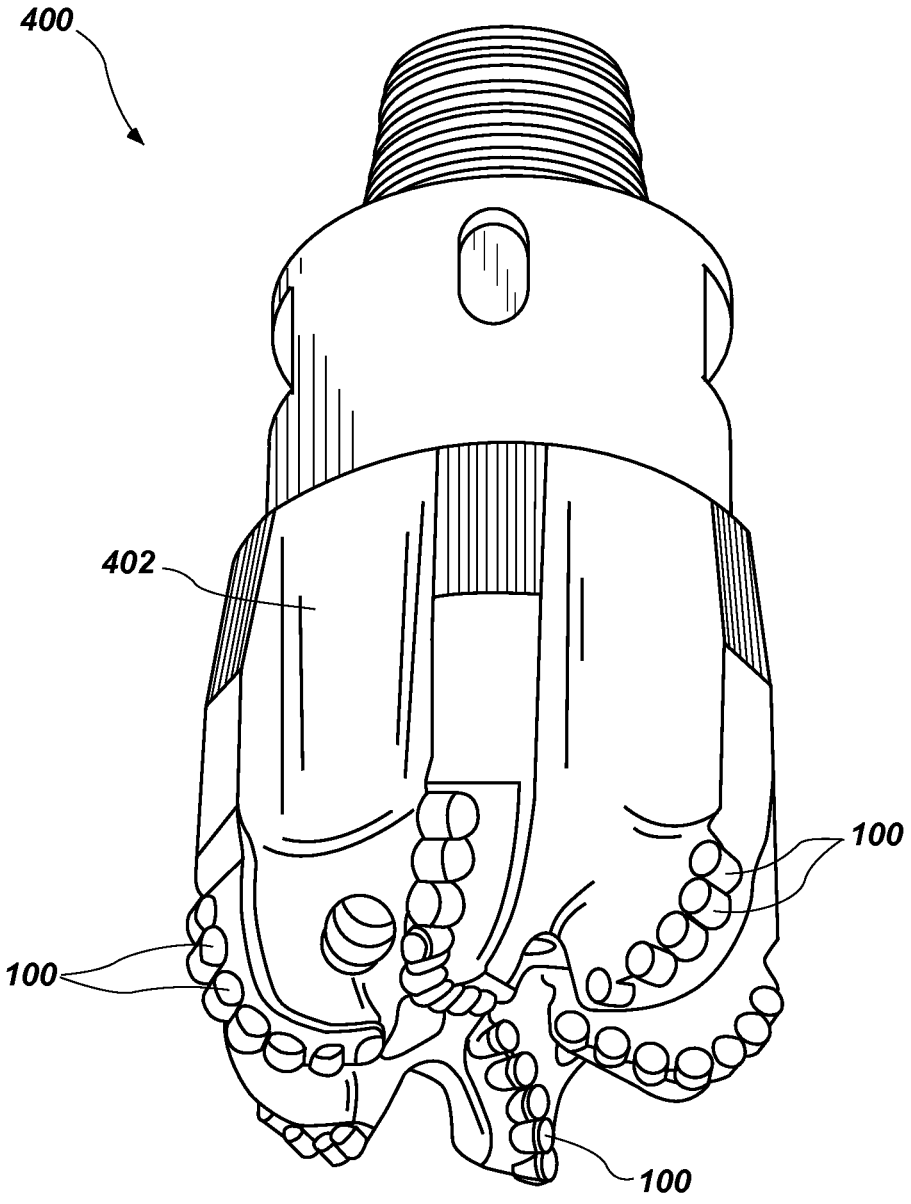
FIG. 6 is a perspective view of an embodiment of an earth-boring tool of the present disclosure that includes a plurality of cutting elements formed in accordance with embodiments of the present disclosure.

Embodiments of PDC cutting elements 100 of the present disclosure that include a multi-portion diamond table 102 as illustrated in FIG. 1 and FIG. 2, may be formed and secured to an earth-boring tool such as, for example, a rotary drill bit, a percussion bit, a coring bit, an eccentric bit, a reamer tool, a milling tool, etc., for use in &Lining wellbores in subterranean formations. As a non-limiting example, FIG. 6 illustrates a fixed cutter type earth-boring rotary drill bit 400 that includes a plurality of cutting elements 100, at least some of which comprise a multi-portion diamond table 102 as previously described herein. The rotary drill bit 400 includes a bit body 402, and the cutting elements 100, at least some of which include multi-portion diamond tables 102, are bonded to the bit body 402. The cutting elements 100 may be brazed (or otherwise secured) within pockets formed in the outer surface of the bit body 402.

Figure 7A:
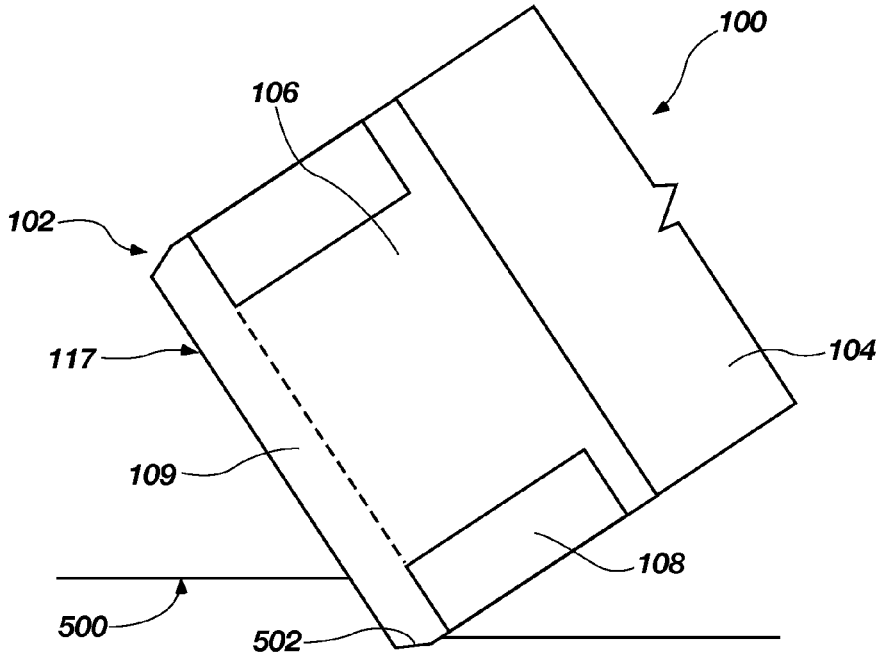
FIGS. 7A and 7B are enlarged cross-sectional views of a cutting element of an embodiment of the present disclosure having a multi-portion diamond table as depicted in FIG. 1 and FIG. 2 engaging a formation.
Figure 7B:
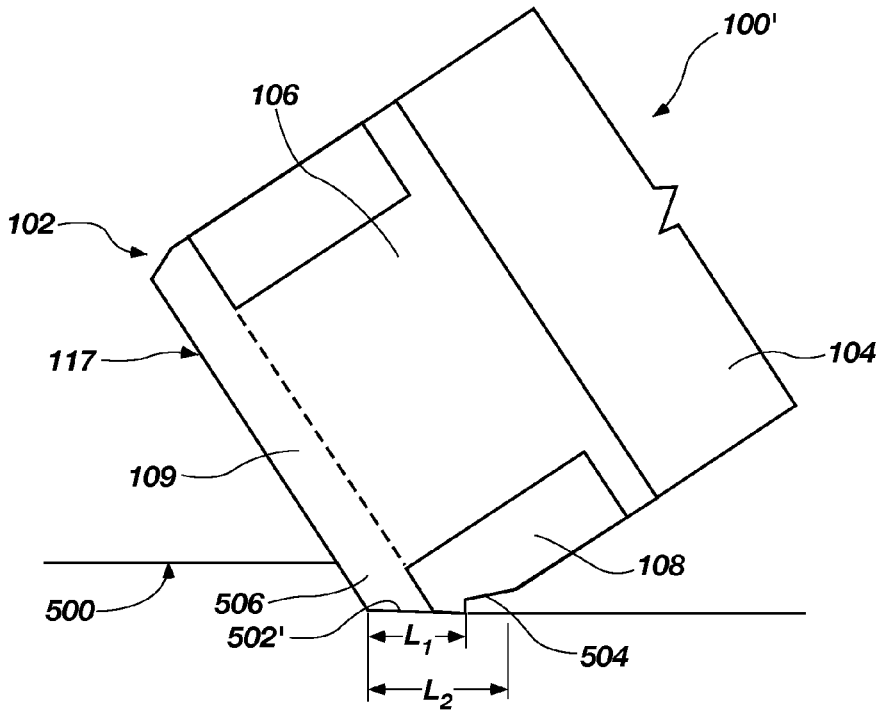

FIGS. 7A and 7B show the PDC cutting element 100 of FIGS. 1 or 2 as it engages with a subterranean formation 500, such as when the cutting element 100 is secured to the earth-boring rotary drill bit 400 of FIG. 6. FIG. 7A shows the PDC cutting element 100 as it first engages the formation 500. The PDC cutting element 100 includes a bearing surface 502 between the cutting element 100 and the formation 500. FIG. 7B shows a dulled PDC cutting element 100' after engaging the formation 500. As shown in FIG. 7B, the bearing surface 502 of FIG. 7A has been worn to form a bearing surface 502'. Because the second portion 108 includes the second material 206 (FIG. 2B), which promotes a higher rate of degradation of the polycrystalline diamond than the third portion 109 (FIG. 1) having the first material 204 at least substantially removed therefrom, the polycrystalline material in second portion 108 degrades or wears faster than the third portion 109 due to frictional temperature-induced back-graphitization of the diamond-to-elemental carbon as the PDC cutting element 100 engages the formation 500. Alternatively, the second portion 108 includes the second material 206 (FIG. 2B), which promotes a higher rate of degradation than the first portion 106 (FIG. 2) having the first material 204 (FIG. 2A), which causes the polycrystalline material in the second portion 108 to degrade or wear faster than the first portion 106 due to frictional temperature-induced back graphitization of the diamond-to-elemental carbon as the PDC cutting element 100 engages the formation. As the second portion 108 degrades or wears, a groove 504 forms around a portion of the sidewall 120 of multi-portion diamond table 102 in the area of second portion 108. A lip structure or abutment 506 is formed in the third portion 109 (FIG. 1) or the first portion 106 (FIG. 2) under the cutting edge 117 due to the undercut in the side wall provided by degradation of the diamond in second portion 108. Cutting elements having a preformed abutment 506 are known in the art and described in detail in U.S. Publication No. 2006/0201712, now U.S. Pat. No. 7,861,808, issued Jan. 4, 2011, to Zhang et al. (filed Mar. 1, 2006) the entire disclosure of which is incorporated herein by this reference.

As the abutment 506 is worn away, the area of bearing surface 502' between the dulled cutting element 100' and the formation 500 remains at least substantially uniform. As a result, the area of bearing surface 502' is smaller than a bearing surface of a conventional cutter, which includes a substantial wear scar. For example, as illustrated in FIG. 5B, the bearing surface 502' of the dulled cutting element 100' has a length $L_1$ while a bearing surface of a conventional cutter, which does not include the abutment 506, would have a length of $L_2$. Thus, the area of bearing surface 502' of the dulled cutting element 100' may be at least about 20% smaller than the bearing surface of a dulled conventional cutting element.

As a result of a smaller area of bearing surface 502' of the dulled cutting element 100', less WOB is required to maintain a desired ROP. Additionally, the durability and efficiency of the dulled cutting element 100' may be improved. Because the smaller bearing surface 502' of the dulled cutting element 100' has a sharper edge than a conventional cutter, a more efficient cutting action results, and when the region of the diamond table 102 adjacent the cutting face 117 and chamfer 118 and between second portion 108 and cutting face 117 has been leached of the first material 204, the dulled cutting element 100' is less likely to experience mechanical or thermal breakdown, or spall or crack.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. A method of forming a polycrystalline diamond compact cutting element for an earth-boring tool, comprising:

forming a diamond table comprising a polycrystalline diamond material and a first material disposed in interstitial spaces between inter-bonded diamond crystals of the polycrystalline diamond material;

at least substantially removing the first material from the interstitial spaces in a portion of the polycrystalline diamond material in a region of the diamond table adjacent a sidewall of the diamond table and spaced from a cutting face of the diamond table; and introducing a second material formulated to promote a higher rate of degradation of the polycrystalline diamond material responsive to exposure to an elevated temperature than a rate of degradation of the first material under a substantially equivalent elevated temperature into the interstitial spaces between the inter-bonded diamond crystals in the portion of the polycrystalline diamond material.

2. The method of claim 1, wherein the region of the diamond table adjacent the sidewall of the diamond table and spaced from the cutting face of the diamond table comprises an annular region.

3. The method of claim 2, further comprising removing the first material from the cutting face of the diamond table.

4. The method of claim 3, wherein introducing the second material into the interstitial spaces between the inter-bonded diamond crystals in the portion of the polycrystalline diamond material comprises:

masking the diamond table to leave an unmasked portion over the annular region adjacent the sidewall of the diamond table; and introducing the second material into the interstitial spaces between the inter-bonded diamond crystals in the annular region through the unmasked portion of the diamond table.

5. The method of claim 1, wherein the first material comprises cobalt or a cobalt alloy and introducing a second material to promote a higher rate of degradation of the inter-bonded diamond crystals responsive to exposure to an elevated temperature than a rate of degradation of the first material under a substantially equivalent elevated temperature comprises introducing the second material comprising elemental iron or an iron alloy.

6. The method of claim 1, wherein introducing the second material to promote a higher rate of degradation of the inter-bonded diamond crystals responsive to exposure to an elevated temperature than a rate of degradation of the first material under a substantially equivalent elevated temperature comprises introducing the second material comprising a stronger catalyst than the first material.

7. A method of drilling, comprising:

engaging at least one cutter with a formation, the at least one cutter including a diamond table comprising:

a first region of polycrystalline diamond material comprising a first material in interstitial spaces between inter-bonded diamond crystals in the first region of polycrystalline diamond material; and a second region of polycrystalline diamond material comprising a second material in interstitial spaces between inter-bonded diamond crystals in the second region of polycrystalline diamond material, the second material inducing a higher rate of degradation of the polycrystalline diamond material than the first material under approximately equal elevated temperatures; and wearing the second region of polycrystalline diamond material faster than the first region of polycrystalline diamond material by forming a recess in the second region in a portion of a sidewall of the diamond table and spaced from a cutting face of the diamond table as friction from engagement of the at least one cutter with the formation increases the temperature of the first region and the second region.

8. A polycrystalline diamond compact (PDC) cutting element for use in an earth-boring tool, comprising:

a first region of polycrystalline diamond material comprising a first material in interstitial spaces between inter-bonded diamond crystals in the first region of polycrystalline diamond material; and a second region of polycrystalline diamond material comprising:

a region extending around at least a portion of a periphery of a sidewall of the PDC cutting element and spaced from a cutting face of the PDC cutting element; and a second material in interstitial spaces between inter-bonded diamond crystals in the second region of polycrystalline diamond material, the second material inducing a higher rate of degradation of the polycrystalline diamond material than the first material under approximately the same elevated temperature.

9. The PDC cutting element of claim 8, wherein the region extending around the at least a portion of the periphery of the sidewall of the PDC cutting element and spaced from the cutting face of the PDC cutting element comprises an at least substantially annular region.

10. The PDC cutting element of claim 9, further comprising another region of polycrystalline diamond material substantially free of both the first material and the second material at least in part between the at least substantially annular region and a cutting face of the PDC cutting element.

11. The PDC cutting element of claim 8, wherein the second material comprises elemental iron or an iron alloy and the first material comprises elemental cobalt or a cobalt alloy.

12. The PDC cutting element of claim 8, wherein the second material comprises a stronger catalyst than the first material.

13. An earth-boring tool, comprising:

a body; and at least one polycrystalline diamond compact (PDC) cutting element attached to the body, the at least one PDC cutting element having a diamond table on a surface of a substrate, the diamond table comprising:

a first region of polycrystalline diamond material disposed at least adjacent a surface of the substrate, the first region comprising a first material in interstitial spaces between inter-bonded diamond crystals in the first region of polycrystalline diamond material; and a second region of polycrystalline diamond material spaced from a cutting face of the diamond table between the first region of polycrystalline diamond material and a side of the diamond table, the second region comprising a second material in interstitial spaces between inter-bonded diamond crystals in the second region of polycrystalline diamond material, the second material promoting a higher rate of degradation of the polycrystalline diamond material than the first material under substantially equivalent elevated temperatures.

14. The earth-boring tool of claim 13, the diamond table further comprising another region of polycrystalline diamond material substantially free of both the first material and the second material and located at least in part between the second region and the cutting face of the PDC cutting element.

* * * * *